US008767027B2

(12) United States Patent
Anderson et al.

(10) Patent No.: US 8,767,027 B2
(45) Date of Patent: Jul. 1, 2014

(54) PREVENTING COIL OVERHEATING IN LINE PRINTER HAMMER BANKS

(71) Applicant: Printronix, Inc., Irvine, CA (US)

(72) Inventors: Greg Anderson, Long Beach, CA (US); Connie Bowen, Santa Ana, CA (US); Raul Velasquez, Los Angeles, CA (US)

(73) Assignee: Printronix, Inc., Irvine, CA (US)

( * ) Notice: Subject to any disclaimer, the term of this patent is extended or adjusted under 35 U.S.C. 154(b) by 63 days.

(21) Appl. No.: 13/654,175

(22) Filed: Oct. 17, 2012

(65) Prior Publication Data

US 2014/0104339 A1 Apr. 17, 2014

(51) Int. Cl.
*B41J 2/28* (2006.01)
*B41J 29/377* (2006.01)

(52) U.S. Cl.
USPC ..... 347/194; 400/124.03

(58) Field of Classification Search
USPC ..... 347/53, 171, 188, 189, 194, 211; 400/120.09, 120.14, 124.03, 279
See application file for complete search history.

(56) References Cited

U.S. PATENT DOCUMENTS 4,540,295 A * 9/1985 Okunishi et al. ..... 400/124.03
5,059,044 A * 10/1991 Takaishi ..... 400/120.14
6,109,802 A * 8/2000 Iwama et al. ..... 400/279

* cited by examiner

*Primary Examiner* — Anh T. N. Vo
(74) *Attorney, Agent, or Firm* — Haynes and Boone, LLP

(57) ABSTRACT

In one embodiment, a method for preventing hammer coils of a line printer hammer bank from overheating during printing includes establishing the maximum allowable temperature threshold of any given hammer coil, monitoring the temperature of all hammer coils during printing, keeping a moving average of dots printed per unit time on each hammer coil, and if one or more coils reach a temperature higher than the threshold, determining the current maximum dot-per-hammer density that the hot coils can print per stroke of the hammer bank that will enable them to cool down adequately from their current temperatures. The rate of printing is restricted to this current established maximum dot-per-hammer density on only those coils which have a temperature at or above the maximum allowable temperature, minus a suitable hysteresis.

20 Claims, 9 Drawing Sheets

PREVENTING COIL OVERHEATING IN LINE PRINTER HAMMER BANKS

BACKGROUND

1. Technical Field

This invention relates to impact matrix line printers in general, and more particularly, to methods and apparatus for preventing overheating of line printer hammer bank coils.

2. Related Art

Line impact matrix printers, or "line printers," produce letters and graphics in the form of a matrix of dots by employing a "shuttle" mechanism that runs back and forth in a horizontal direction over a page of a print medium, such as single sheet or continuous form paper, coupled with the intermittent movement of the page perpendicular to that of the shuttle. An inked "ribbon" is typically interposed between the shuttle and the page. The shuttle comprises a "hammer bank," i.e., an inline row of "hammers," i.e., cantilevered, magnetically retracted printing tips respectively disposed at the ends of elongated spring fingers, each of which is selectively "triggered," i.e., electromagnetically released, and timed so as to impact the page through the ink ribbon and thereby place a dot of ink on the page at a selected position. As a result of the ability to precisely overlap the ink dots produced thereby, i.e., both vertically and horizontally, line printers can produce vertical, horizontal and diagonal lines that have a virtually solid appearance, print that closely resembles that of "solid font" printers, and refined graphics similar to those produced by graphics plotters, at speeds of up to 2000 lines per minute (LPM).

Each of the hammers of a line printer hammer bank is electromagnetically actuated at least in part by the application of a current to at least one electrical coil associated with the hammer. These coils typically comprise a long strand of an electrically conductive wire (e.g., copper) that is coated with an insulator and then wound about a spool or bobbin. During printing, the sequential application of an electrical current to the coil causes it to heat up resistively, and hence, its temperature to rise incrementally. If the temperature of the coil is allowed to rise to a critical point at which, e.g., the coat of insulation on the wire is compromised, a short could occur in the coil, causing a malfunction of the associated hammer.

During the great majority of print jobs, the thermal design of the hammer bank is such that the temperature of each of the coils remains well below the critical point. However, in a relatively small number of print job types in which a highly dense pattern is printed on only a small number of adjacent hammers (so that the overall printed dot count remains about average), such as printing an uninterrupted thick black vertical line on only one or two adjacent hammers in a relatively hot room, it is possible that the temperature of the effected coils could rise beyond a desirable level.

It is known that slowing the printing speed of a line printer, i.e., skipping printing during one or more of the left/right traverses, or "strokes," of the hammer bank, enables the coils of the hammer bank, particularly those that are cooled by ambient air, to cool down. Thus, a need exists in the relevant industry for simple, efficient systems for preventing the overheating of the coils of a line printer hammer bank that selectively reduce the speed of the printer in a "smart," i.e., efficient, manner during the infrequent "boundary" cases described above so as to enable the coils to cool down and thereby prevent the temperature of the coils from rising to the critical temperature, but which have no effect on performance of the printer during most typical print jobs.

SUMMARY

In accordance with embodiments of the present invention, methods and apparatus are provided for preventing the coils of line printer hammer banks from overheating that are effective, efficient, easy and low in cost to implement.

In one embodiment, a method for preventing a hammer coil of a line printer hammer bank from overheating during printing comprises establishing a maximum allowable temperature of the coil, $T_S$, a temperature hysteresis H value for the coil, and an initial value of a hard brake maximum dot-per-hammer density, HCDPHMax, that the coil can print per stroke of the hammer bank that will enable the coil to cool down from the maximum allowable temperature $T_S$. The temperature of the coil is then monitored during printing, and if the temperature of the coil rises to or exceeds $T_S$, the method flags the coil as a hot coil, "HC." The initial value of HCDPHMax is then dynamically adjusted, based on the rate of cooling of the coil, and the rate of printing by the coil is adjusted to HCDPHMax when and for as long as the temperature of the coil is at or above $T_S$–H.

A better understanding of the above and many other features and advantages of the novel methods and apparatus of the present invention, together with their manufacture and use, can be obtained from a consideration of the detailed description of some example embodiments thereof below, particularly if such consideration is made in conjunction with the appended drawings, wherein like reference numerals are used to identify like elements illustrated in one or more of the figures thereof.

DETAILED DESCRIPTION

In accordance with this disclosure, methods and apparatus are provided for effecting over-temperature protection for the coils of line printer hammer banks, which are both efficient and reliable, yet easy and relatively low in cost to implement.

Figure 1:
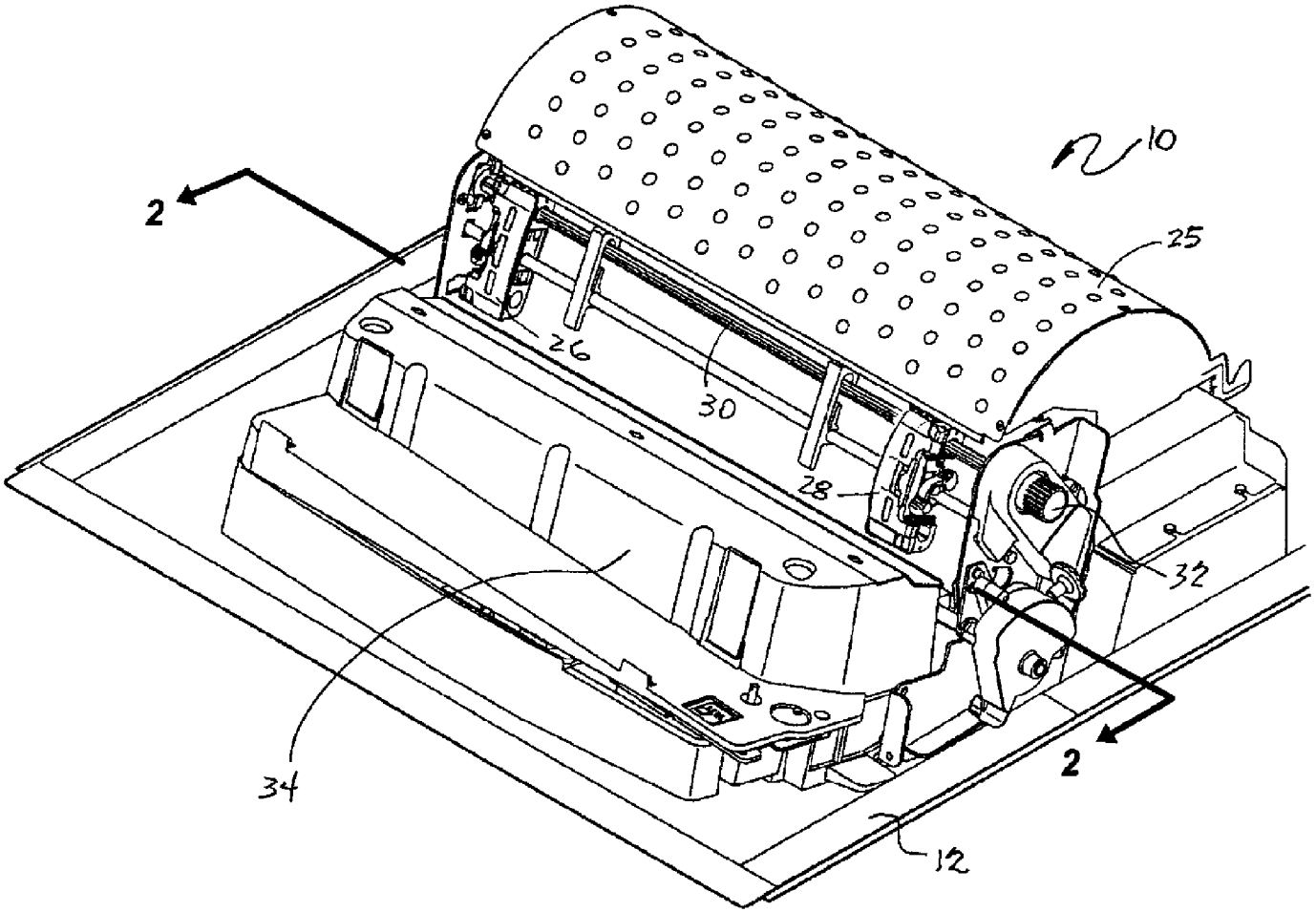
FIG. 1 is a partial, upper, front and right-side perspective view of an example line matrix impact printer within which embodiments of the present invention can be advantageously employed.

FIG. 1 is a perspective view of an example line matrix impact printer 10 within which embodiments of the present invention can be advantageously employed. As illustrated in FIG. 1, the printer 10 can be mounted on a stand or a base, or incorporated in a cabinet. In the particular embodiment illustrated, the printer 10 is shown supported within a base frame 12. The base frame 12 supports all of the various components of the printer 10, including a cartridge ribbon system 20 (see FIG. 4), which comprises an "endless" or Mobius strip of ink ribbon 22 (see FIG. 4) housed inside a cartridge that is fed across the paper by a motor, which creates tension on the ribbon 22 by use of gears on one side and a tension spring on the opposite side of the cartridge. The cartridge ribbon system 20 feeds ribbon horizontally over a print medium 24 (see FIG. 4) to enable ink transfer from the ribbon to the paper and thereby create printed images as the hammers fire.

In the example embodiment illustrated in FIG. 1, the print medium 24 is arranged to advance vertically over an arcuate support plate 25. The print medium 24 can comprise, for example, single sheets, fan-fold forms or continuous sheets, bar code labels, combinations of plastic and paper labels and formats, paper media for text and graphics, and other such materials. In the particular embodiment illustrated in FIG. 1, the print medium 24 is moved vertically up and over the support plate 25 by sprocket drive "tractors" 26 and 28, which are conjointly driven by a media drive shaft 30. Of course, other known media drive mechanisms, such as frictional drive wheels, can also be used. The media drive shaft 30 also incorporates a knurled knob 32 for manually incrementing the vertical position of the medium 24. The knob 32 can be utilized to move the medium 24 manually, e.g., for indexing or initial alignment of the print medium 24, or for other purposes.

The example line printer 10 of FIG. 1 further includes a "shuttle" 34 incorporating a scotch yoke mechanism that causes a "hammer bank" 100 (see FIG. 2) to be driven back and forth over the ink ribbon 22 and the print medium 24 in the horizontal direction. As described in more detail below, the hammer bank 100 includes an inline row of cantilevered, magnetically retracted "hammers," i.e., printing tips respectively disposed on the ends of elongated spring fingers, each of which is selectively "triggered," i.e., electromagnetically released, and timed so as to impact the page through the ink ribbon and thereby place a dot of ink on the page.

In some embodiments that print at a rate of 500 LPM, the hammer bank 100 can include, for example, 28 hammers that print a field of dots 13.6 inches wide, i.e., about 0.5 inches/hammer, and in other embodiments that print 1000 LPM, the hammer bank 100 can include, for example, 60 hammers, each printing a field of dots about 0.23 in. wide. However, it should be understood that, although the particular example line printers illustrated and described herein conform to the two foregoing examples for purposes of illustration, line printers that are capable of other line speeds and/or that incorporate other numbers of hammers can be realized, and that the methods described herein, with suitable modifications to accommodate these differences, can easily be incorporated in the latter.

As discussed in more detail below, a controller 200 (see FIG. 4) incorporating one or more microprocessors can be disposed within the printer 10 and utilized to control the various printer components, including the driving of the ribbon 22 of the ribbon cartridge 20, the reciprocating lateral movement of the hammer bank 100 by the shuttle mechanism 34, the vertical movement of the print medium 24 by the tractors 26 and 28 relative to the hammer bank 100, and the selective firing of the hammers against the ribbon 22 and print medium 24 to effect the printing of the ink in the form of dots onto the print medium 24. As discussed in more detail below, the controller 200 can also be advantageously utilized to implement the methods of the present invention for preventing hammer coil overheating.

Figure 2:
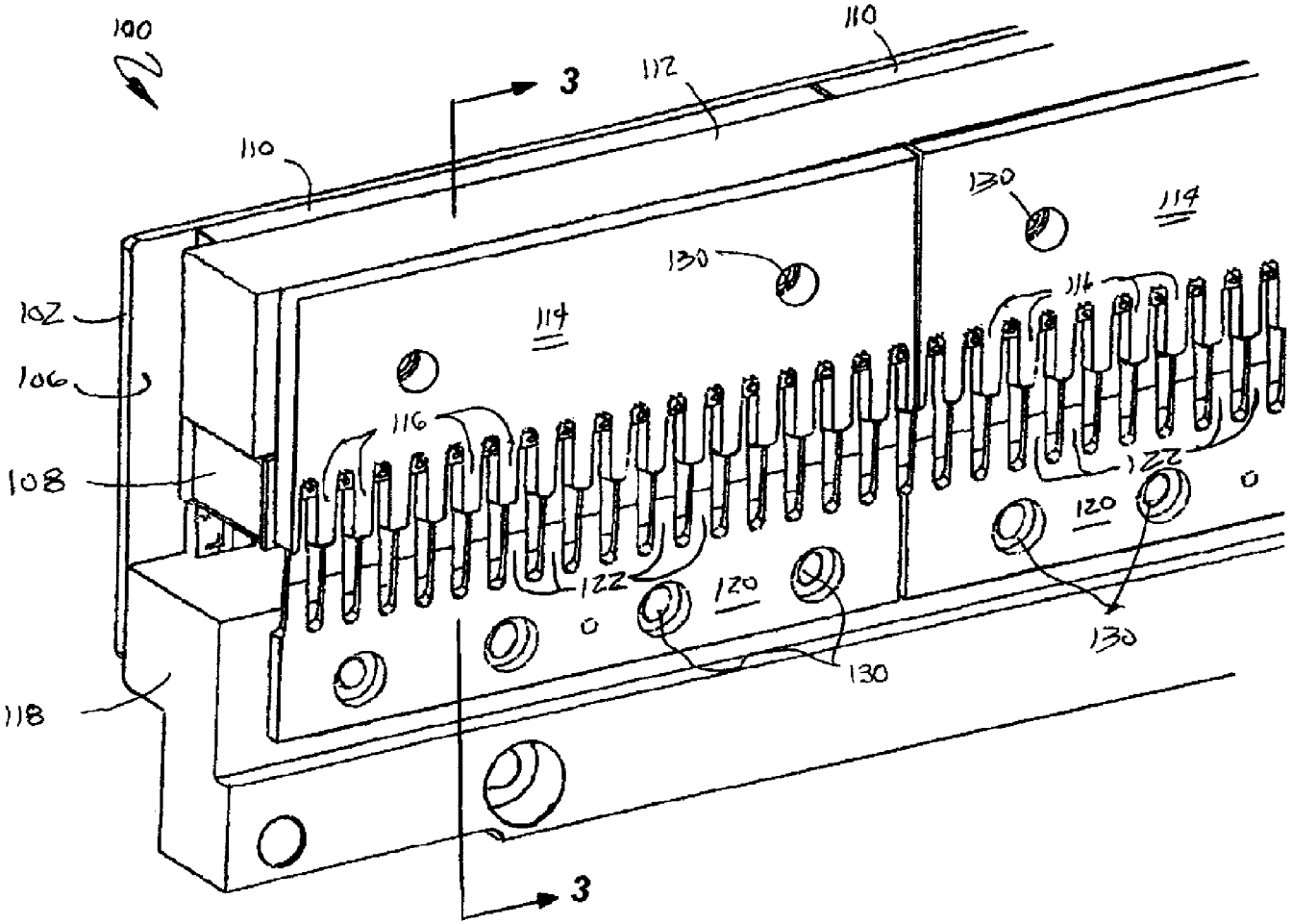
FIG. 2 is a partial, lower, front and left-side perspective view of a front face of an embodiment of a hammer bank incorporating coil overheating protection in accordance with the present invention, as seen along the lines of the section 2-2 taken in FIG. 1.
Figure 3:
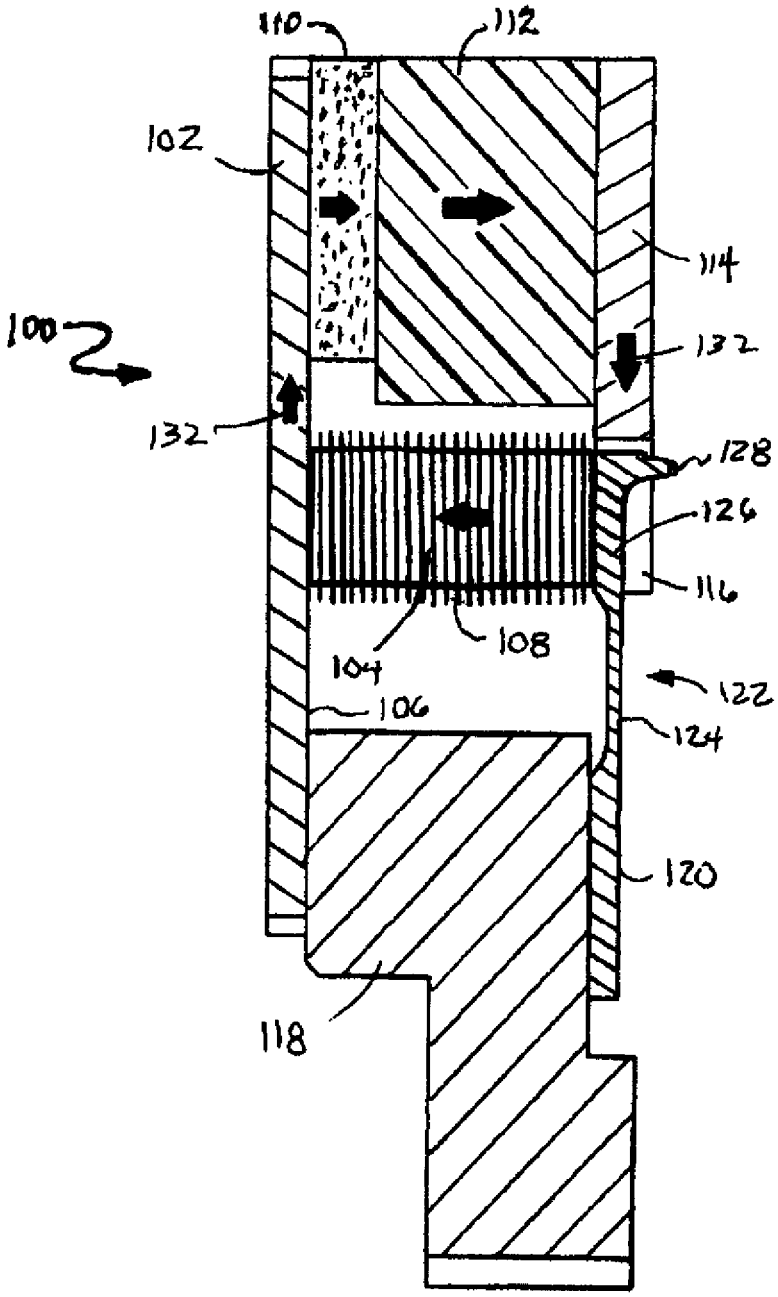
FIG. 3 is a sectional view of a single impact hammer of the hammer bank of FIG. 2, as seen along the lines of the section 3-3 taken therein.

FIG. 2 is a partial, upper, front and left-side perspective view of a front face of an example embodiment of a hammer bank 100 of a type disclosed in commonly owned, co-pending Application No. 13/654,095, incorporated herein by reference, with which the temperature control systems and methods of the present invention may be advantageously used. FIG. 3 is a sectional view of the example hammer bank 100 of FIG. 2, as seen along the lines of the section 3-3 taken therein, showing details of a single impact hammer and associated control magnetics thereof.

As illustrated in FIGS. 2 and 3, the example hammer bank 100 includes a back plate 102 and a plurality of elongated pole pieces 104 extending forwardly from a front surface 106 thereof. Of importance herein, each pole piece 104 has an electrical coil 108 disposed about a circumfery thereof.

In the particular example embodiment of FIGS. 2 and 3, and referring to the upper portions thereof, a permanent magnet 110 has a back surface that is magnetically coupled to the front surface 106 of the back plate 102, and a flux bar 112 has a back surface that is magnetically coupled to a font surface of the permanent magnet 110. A shunt fret 114 defining a plurality of elongated, downwardly extending shunts 116 has a back surface that is magnetically coupled to a font surface of the permanent magnet 110.

Referring now to the lower portions of FIGS. 2 and 3, a hammer fret mounting bar 118 has a back surface that is magnetically coupled to the front surface 106 of the back plate 102, and a hammer fret 120 has a back surface that is magnetically coupled to a front surface of the hammer fret mounting bar 118. The hammer fret 120 defines a plurality of elongated, upwardly extending hammers 122. Each hammer 122 is interdigitated between a pair of adjacent shunts 116 and includes an elongated spring portion 124 that has a hammer head 126 disposed at an upper end thereof. Each hammer head 126 has a printing tip or pin 128 projecting forwardly therefrom.

As illustrated in FIGS. 2 and 3, the back plate 102, permanent magnet 110, flux bar 112, shunt fret 114, hammer fret mounting bar 118 and hammer fret 120 can be sandwiched with each other and held together in a rigid assembly by, for example, a plurality of fasteners 130, such as bolts or screws, that can extend partially or completely through the assembly. Additionally, as can be seen in FIG. 2, in some embodiments, the permanent magnet 110, shunt fret 114 and hammer fret 120 can be split into bilaterally symmetrical halves for ease of manufacture and assembly without adversely affecting the function of the hammer bank 100.

Figure 5:
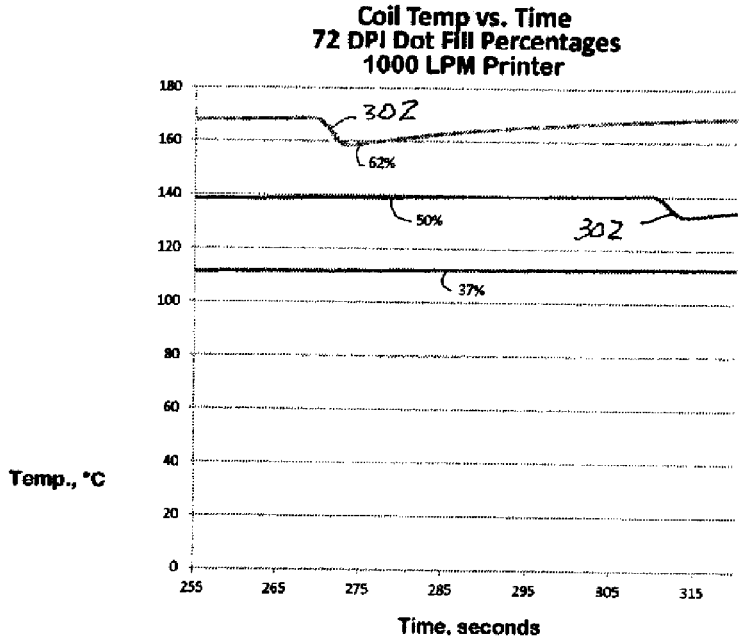
FIG. 5 is a graph of the temperature of a line printer hammer coil in an example 1000 LPM printer, printing at a resolution of 72 dots per inch (dpi), as a function of time and the average dot density being printed by the coil, showing the cooling of the coil resulting from a two-second interruption in printing by the coil.

As those of some skill in this art will understand, it is desirable that at least the back plate 102, the pole pieces 104, the flux bar 112, the shunt fret 114 and the hammer fret 124 be constructed of a magnetically permeable material. As illustrated in FIG. 5, by so doing, a magnetic flux path, or circuit, as indicated by the arrows 132, is established within the hammer bank 100 by the permanent magnet 110. The flux path 132 extends from the permanent magnet 110, through the flux bar 112, the shunt fret 114, the hammers 122, the pole piece 104, the back plate 102, and thence, back to the permanent magnet 110.

The magnetic flux acts to pull the head 126 of the hammer 122 back elastically toward and into juxtaposition with the front end of the pole piece 102 and against a forward pull or bias exerted on the hammer head 126 by the spring portion 124 of the hammer 122. The shunts 116 disposed on either side of the hammer head 126 serve to complete the flux path 132 from the pole piece 102 to the hammer head 126 while enabling the hammer head 126 to move forward freely when released from the pull of the magnetic flux. The hammer head 126 is thus retained in juxtaposition with the pole piece 102 until it is selectably released to spring forwardly in response to the forward bias of the spring portion 124 of the hammer 122. This release is effected by passing an electrical current through the coil 108 so as to induce a magnetomotive force (MMF) in the pole piece 104 that is contrary to, and thus, disruptive of the magnetic flux path 32, thereby releasing the hammer head 126, and hence, the associated printing tip 128, to spring forwardly so as to impact against an ink ribbon and thereby print a dot on a print medium.

Thus, it may be seen that each of the hammers 122 of the hammer bank 100 is electromagnetically actuated at least in part by the selective application of an electrical current to the coil 108 associated with that hammer 122. These coils 108 typically comprise an elongated strand of an electrically conductive wire (e.g., copper) that is coated with a dielectric insulator, e.g., a polyimide, such as Kapton, and then wound about a spool or bobbin, which can be made of a similar insulative material. During assembly, a coil 108 is slipped over each hammer's associated pole piece 104, as illustrated in FIG. 3, and the two ends or leads of the coil 108 are then extended, for example, through openings in the back plate 102, and coupled to the controller 200 disposed internally of the printer 10.

As will understand by those of skill in the art, during printing, the sequential application of an electrical current to the coil 108 causes it to heat resistively, and hence, its temperature to rise. If the temperature of the coil 108 is allowed to rise to a critical point at which the dielectric coating on the wire of the coil 108 is compromised, the coil 108 could short, causing a malfunction of the associated hammer 122. As discussed above, during the great majority of print jobs, the thermal design of the hammer bank 100 is such that the temperature of each of the coils 108 remains well below this critical point. However, in a relatively small number of print jobs, it is possible that the temperature of the effected coils 108 could rise beyond an acceptable level, thereby indicating a need for methods for protecting the coils 108 from a destructive overheating.

Additionally, in some prior art hammer banks, it is conventional to "pot," or embed, the coils 108 and pole pieces 104 in a matrix of, for example, epoxy, for both structural and thermal considerations. Thus, for example, as illustrated in FIG. 3, a cavity 134 could be formed in the hammer bank 100, e.g., inboard of the back plate 102, magnet 110, flux bar 112, shunt fret 114, and hammer fret mounting bar 118, within which a bed of potting material could be dispensed so as to encapsulate the pole pieces 104 and coils 108 therein, as in some hammer banks of the prior art.

However, in the particular example hammer bank 100 illustrated in FIGS. 2 and 3, in order to reduce the cost of lower speed shuttle mechanisms (for example, those of the example 500 and 1000 LPM line printers described herein), the design of the hammers 122 illustrated is modified to simplify their construction and assembly, and of importance herein, the coils 108 are not potted within an epoxy compound. As a result, the coils 108 are exposed to ambient air so as to both heat up and cool down more rapidly than those in prior art hammer banks that are potted, and as a consequence, require extra protection against overheating, as provided by the methods discussed below.

Figure 4:
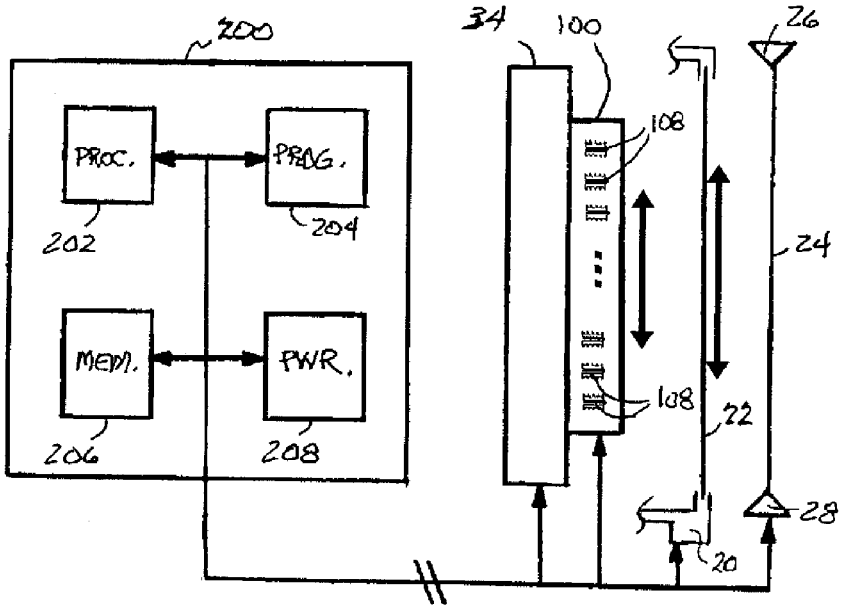
FIG. 4 is a functional block diagram of a controller utilized to control the various components of the line printer of FIG. 1, including the implementation of the methods of the present invention for preventing coil overheating.

FIG. 4 is a functional block diagram of an example controller 200 that can be utilized to control the various components of a line printer 10, including the implementation of the methods for preventing coil overheating of the present invention. As discussed above, the controller 200 is bi-directionally coupled with and responsible for, among other things, controllably driving the ink ribbon 22 of the ink ribbon cartridge 20, the reciprocating lateral movement of the hammer bank 100 of the shuttle mechanism 34, the vertical movement of the print medium 24 by the tractors 26 and 28 relative to the hammer bank 100, and the selective "firing" of the hammers against the ribbon 22 to effect the printing of the ink in the form of dots onto the print medium 24.

As illustrated in FIG. 4, the example controller 200 can include a processor section 202 incorporating, e.g., one or more processors, for example, one or more RISC processors, a reprogrammable program storage section 204 that can store operating instructions for the printer, including the algorithms for preventing overheating of the coils 108 of the hammer bank 100 described herein, an erasable, re-writable memory section 206 for storing, e.g., the coil physical parameters discussed below, and a power supply section 208 that can supply conditioned, regulated AC and DC power to the controller 200 and/or any one of the foregoing printer components.

Turning now to methods that can be used for preventing overheating the coils of a line printer hammer bank, one example method can be viewed as generally involving 1) establishing a maximum allowable temperature ($T_S$) of the coils, 2) monitoring the temperature of the coils during printing, and 3) if and when the temperature of a coil (i.e., a "hot coil" or "HC") reaches or exceeds the maximum allowable temperature $T_S$, reducing the performance of the printer in a maximally efficient way so as to enable the HC to cool down without skipping printing strokes unnecessarily.

The third step, i.e., reducing the performance of the printer in a maximally efficient way, involves 1) establishing a maximum dot-per-hammer density of a HC ("HCDPHMax"), as a percentage of the greatest possible density of dots that the HC hammer can print during a given stroke of the hammer bank and at a given resolution, that will enable the HC to cool down from the maximum allowable temperature $T_S$ to an "acceptable" lower temperature, 3) looking ahead to the HC dot-per-hammer ("next HCDPH") density that the HC is about to print during the next stroke of the hammer bank, 4) calculating a new HC dot-per-hammer moving average (HCDPHMA) based on the next HCDPH, and 5) either a) printing the next stroke HCDPH if it is less than or equal to the HCDPHMax, or b) skipping the printing of the next stroke HCDPH on that stroke and then printing it during the next or a subsequent stroke of the hammer bank. Thus, in this method, if the dot density being printed on a HC is reduced, the printer will not wait for the HC to cool completely, but instead, will increase its performance immediately, since the dot density being printed on that HC is adapted to allow cooling of the HC without skipping extra printing strokes.

Figure 6:
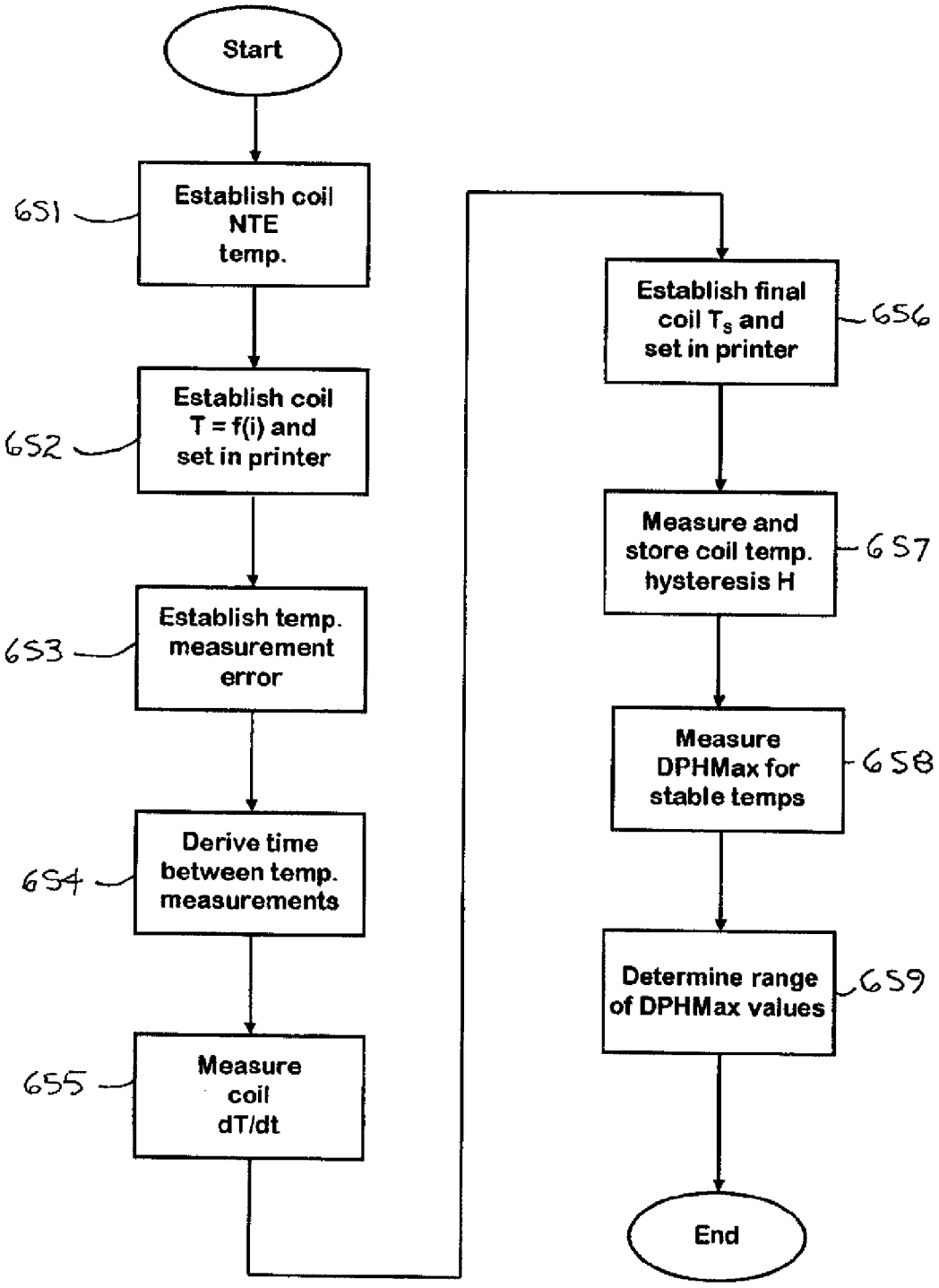
FIG. 6 is a diagram illustrating the steps of an example method for obtaining hammer coil physical parameters utilized by the coil overheating prevention methods of the present invention and for storing them in a line printer implementing such methods.

FIG. 6 is a diagram illustrating the steps of an example method 300 for acquiring, deriving and/or establishing the above hammer bank/coil physical parameters, including the maximum allowable coil temperature $T_S$ and the maximum allowable dot-per-hammer density ("HCDPHMax") of a HC that has reached its $T_S$, which are utilized by the methods of the present invention for preventing coil overheating. As will be understood, these parameters are generally empirically derived, specific to the particular hammer bank and coils of the line printer in which the hammer bank is installed and, unless the design of the coils, hammer bank and/or printer is changed substantially, remain relatively fixed for the useful life of the hammer bank.

Accordingly, the steps of the method 300 of FIG. 6 typically need to be performed only once for a particular hammer bank design, and then stored in the associated printer, for example, in the erasable, re-writable memory section 206 of the controller 200, or in the code of the operating instruction or programming stored in the program storage section 204. The storing is typically performed at the factory, except when the hammer bank of a printer is being replaced with a hammer bank having different coil parameters than those previously "set" in the printer.

In regard to the latter possibility, it is important to note that the instant method can automatically require the factory to set, e.g., the maximum coil temperature $T_S$ values using, for example, a hidden "menu" generated by the software of the method and to display a suitable reminder message to the assembler on a display of the printer, such as, "Set Coil Temp $T_S$". Thus, if the factory fails to set or store the $T_S$ of the coils in the printer initially, the software of the protection method can easily be adapted to display a "fatal error" message at power up, for example, "CTEMP NOT SET/Set Coil Temp" to indicate that the needed values are missing and should be supplied.

However, when a new hammer bank is installed in a printer in the field, the control software may or may not know that the hammer bank has been changed, and accordingly, could continue to use the coil parameter values previously stored in the printer at the factory. Without proper coil temperature $T_S$ settings, among others, the coil overheating method might not function properly, and the coils in the new hammer bank could be damaged. Therefore, technicians who install new hammer banks in the field should be educated as to the extreme importance of accessing the "Set Coil Temp" menu and setting the new $T_S$ (and other values) for the coils any time they change out the hammer bank unit in a printer.

As illustrated in FIG. 6, the coil parameter acquisition method 300 begins at step 1 ("6S1") with the establishment of a coil maximum, or not-to-exceed ("NTE"), value, $T_{NTE}$. There are several ways at which this value can be established. However, in one practical embodiment, consideration can be given, for example, to the insulator material coating the respective wires of the coils, and in particular, to the temperature at which the insulator could become compromised, e.g., by melting. Thus, for example, in one example embodiment, the insulation on the wires of the hammer coils might be specified by the manufacturer to "run," i.e., maintain its functional integrity, for, say, at least 2000 hours at 185° C. Accordingly, the coil overheating method should be designed in this case to ensure that the printer does not print at such a rate that the hammer bank coils get either hotter than 185° C. or remain at that temperature for an extended period time. That is, under such conditions, the method should be configured to reduce printing speed in a manner designed to allow the hottest coil(s) of the hammer bank to cool.

Thus, in the particular example of FIG. 6, at 6S1, a "first cut" at a maximum coil temperature would be to set $T_S=T_{NTE}=185°$ C. However, there are some possible sources of error or other considerations that should be taken into account in establishing the value of $T_S$, for example, 1) the amount of possible error in the coil temperature measurement itself, $T_{ER}$ (e.g., +/− a number of degrees), 2) the amount of time that a coil can heat before a measurement of its temperature can be made, and 3) the amount that the temperature of the coil can increase during that time. In some embodiments, the upper bounds of these possible sources of error or correction can be established empirically.

For example, regarding the coil temperature measurement error $T_{ER}$ above, consideration should first be made to the way in which the temperature of the coils is actually measured during printing. Although each hammer bank coil could be equipped with, for example, a precision thermistor or a thermocouple that can be used measure its temperature, a less complicated and costly method, using components already at hand, can be used, viz., using, as a surrogate for its temperature, the current i flowing through the coil to actuate the associated hammer. Thus, the current flowing through the coil, i, is inversely proportional to its resistance, which in turn, varies directly with its temperature T. Since the current flowing in a hammer coil can be measured relatively quickly, easily and without effecting the operation of the hammer, this measurement can be used as a substitute for a more direct measurement of its temperature, i.e., T % 1/i.

Changes in the geometry of the coil with temperature can introduce non-linearities in the coil current/temperature relationship, but these can be accommodated empirically by, for example, equipping a representative coil that is disposed at an initial "reference" temperature of, e.g., 25° C. (77° F.), then passing increasing amounts of current through it and recording the variation in its temperature as a function of the current. Thus, at 6S2 of the method 300, these values can be stored in, e.g., a lookup table in the memory of the printer controller, or encoded directly in relationships within the software used to control the method, e.g., "if i=X, then T=Y." As discussed above, these relationships need to be obtained only once for the particular type of coils used in the hammer bank and, absent a change in their design, should remain fairly constant over the useful life of the hammer bank.

When the mechanism for measuring the temperature of the coils has been established, then the coil temperature measurement error $T_{ER}$ above becomes mainly a matter of the possible variation in the characteristics of the coils actually used in the hammer bank from those of the representative coil that were measured empirically. Here, past experience with measuring the temperature of hammer bank coils as a function of the current flowing in them can be useful, and shows that this method has, for a wide variety of hammer coil types, an accuracy of about ±9° C. Thus, at 6S3 of the method, a margin of safety attributable to a possible error in the temperature measurement of the coils results in a downward adjustment to the foregoing maximum allowable temperature of the coils $T_S$ of $T_{ER}$=9° C., i.e., a "revised" $T_S$=185−9=176° C. As above, if this value of $T_S$ were selected as the final value, the cutoff point for throttling back performance of the printer should be chosen such that no given hammer bank coil can heat to a temperature higher than 176° C. before a fresh coil temperature reading is taken on that coil.

As discussed above, to establish the latter parameter, consideration should then be given to 2) the amount of time that a coil can heat before a measurement of its temperature is taken, and 3) the amount that the temperature of the coil can increase during that time.

The amount of time that it takes to measure a particular coil's temperature depends, as in 1) above, on the particular line printer and the method in which the temperature of the coils is measured. Since a relatively large number of coil temperature samples can be taken per unit time using the current/temperature measurement method described above, in one advantageous method, coil temperature (i.e., current) samples can be taken during every "turnaround" of the shuttle, i.e., on every "left" and "right" stroke thereof. In this manner, the firing of the hammers, i.e., printing, need not be skipped to take a coil temperature sample, so printer performance will not be affected by the measurements.

In this approach, in one embodiment, the respective temperature of the coils is measured seriatim, on a continuously repeating basis, beginning with the first coil in the hammer bank and proceeding to the last, in a "round robin" fashion. The temperature of the particular coil being measured is taken four times, i.e., once every change in shuttle direction, or stroke, for four consecutive strokes, then averaged together to provide a measurement of the current temperature of that coil, before moving to the next coil in the bank.

In addition to these measurements, the method can be adapted to perform a special coil measurement of the "hottest coil" in the hammer bank once every 0.5 second to detect hot coils more quickly. The instruction to execute this special measurement can be inserted, for example, in the shuttle direction change preceding the next round of coil temperature measurements. As with the other coils, four temperature measurements can be taken on the hottest coil and then averaged to provide a measurement of the current temperature of the hottest coil.

In accordance with the methods of the present invention, if the temperature of any coil exceeds the chosen allowable temperature $T_S$ during these measurements, 1) that coil is internally identified or "flagged" as a hot coil ("HC"), and 2) the printing speed is reduced in the manner described in more detail below until the temperature of the flagged coil drops to a level below the established set temperature $T_S$, plus a chosen "hysteresis" (H) temperature value, as discussed in more detail below.

Using this approach, a HC will be caught or flagged in the worst case after the coil temperature measurements have cycled through the entire bank of coils in the hammer bank. In an example 500 LPM printer having 28 hammers in its hammer bank, this corresponds to a "worst case," or maximum of 3.36 seconds (i.e., at a printer resolution of 90 dpi) before the temperature of a HC is measured again. Thus, at 6S4 of the method 300, and given that a "line" of print is equal to five rows of dots, plus one blank row (for line separation purposes), the derivation of this time is as follows: 500 lines/minute×60 seconds/minute×6 strokes/line=50 hammer bank strokes per second, or 0.02 seconds/stroke, i.e., when printing at a resolution of 60 dpi. Thus, if four strokes are used to measure the temperature of one coil and there are 28 coils in the hammer bank, the time between temperature measurements for a given coil will be 4 strokes/coil×0.02 seconds/stroke×28 coils=2.24 seconds. However, this time interval is proportionately greater at higher print resolutions, which take longer to print. Thus, at a print resolution of 90 dpi, a "worst case" for the time between successive temperature measurements for a coil will be 90/60×2.24 seconds=3.36 seconds.

A similar analysis can be performed for the example 1000 LPM, 60 hammer printer, and results in a worst case time of 3.6 seconds before a HC is read again (as above, at a print resolution of 90 dpi). As before, at less dense print resolutions, sampling is done more quickly. For example, at a resolution of 60 dpi, this time is reduced to 2.4 seconds.

Having established these maximum time-between-measurements values at 6S4, it is then necessary, at 6S5 of the method 300, to establish the rate of change of coil temperature with time, dT/dt, where T is coil temperature and t is time, in order to determine the amount that the temperature of a coil can increase during that period of time. In one example embodiment, to establish this, empirical data is developed by instrumenting the coils of the hammer bank of an example line printer with thermocouples and then recording the temperature of the coils as the printer prints different continuous print patterns, each with a different proportion of all possible dots filled in by the printer.

Figure 7A:
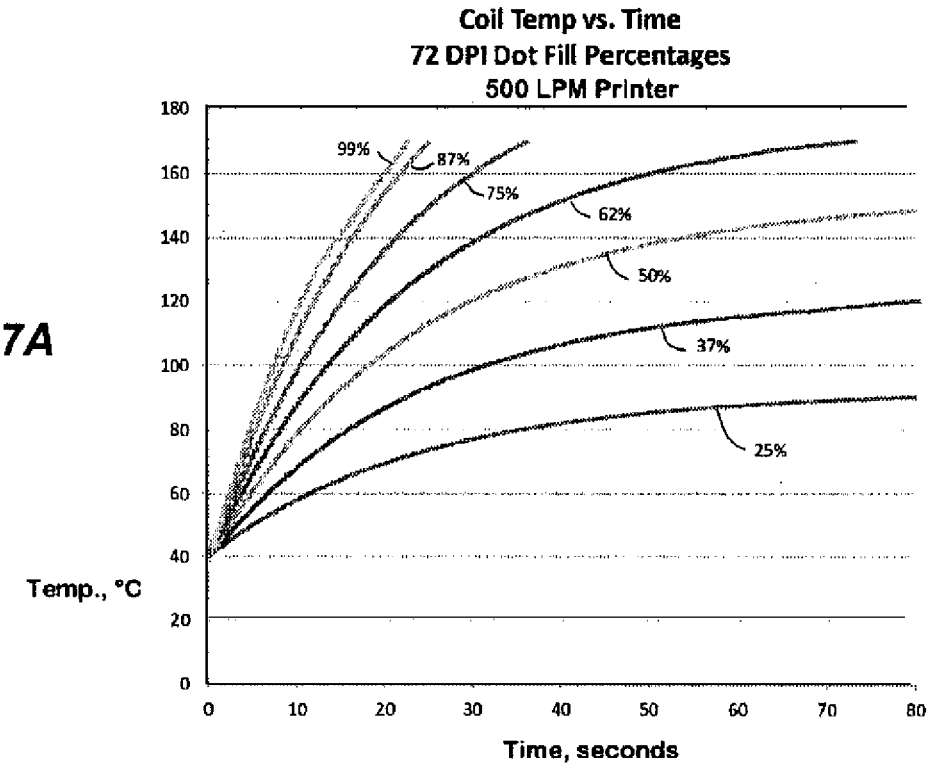
FIG. 7A is a graph of the temperature of a hammer coil in an example 500 LPM printer having 28 hammers and printing at a resolution of 72 dpi as a function of time and the average dot density being printed by the coil.
Figure 7B:
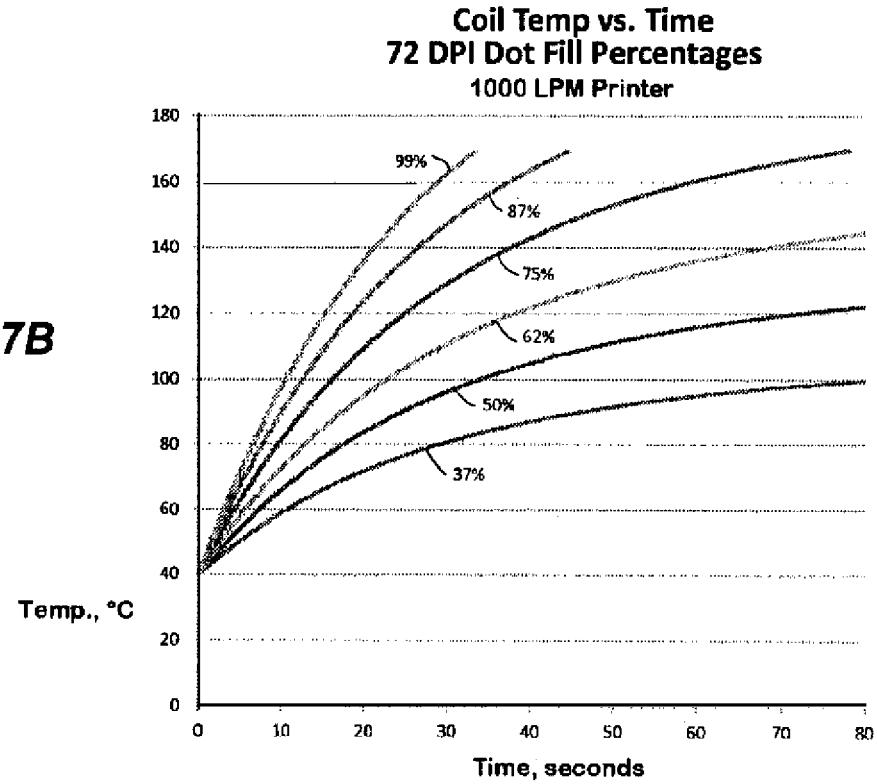
FIG. 7B is a graph of the temperature of a hammer coil in an example 1000 LPM printer having 60 hammers and printing at a resolution of 72 dpi as a function of time and the average dot density being printed by the coil.

FIG. 7A is a graph of the temperature of a representative hammer coil in the example 500 LPM printer above, printing at a resolution of 72 dpi, as a function of time and the average density of the dots being printed by that coil, and FIG. 7B is a graph of the temperature of a representative hammer coil in the example 1000 LPM printer above, printing at a resolution of 72 dpi, as a function of time and the average dot density being printed by that coil. In both cases, a print resolution of 72 dpi was selected because that resolution was found to represent a worst case, i.e., to result in a slightly higher value of dT/dt for the coils than those obtained at print resolutions of either 60 or 90 dpi.

Each graph in FIGS. 7A and 7B includes a "family" of curves in which each curve shows the effect of a continuous print pattern in which a different proportion of all possible dots is filled. Thus, the densest pattern printed was 99% of all possible dots (i.e., of the 72 dpi printable on the given hammer), and the sparsest pattern printed was 25% of all possible dots (i.e., 18 dpi printed on the given hammer). All of the readings were taken at an ambient or reference temperature of about 25° C.

As illustrated in FIG. 7A, the respective slopes of the curves, i.e., dT/dt, is at a maximum at the origin of the graph (where an average operating temperature of 40° C. was selected as the initial temperature of the coils), and decreases with time thereafter. Thus, for the example 500 LPM printer, in the worst case, i.e., with 99% of the possible dots on the coil being printed, the subject coil takes about 1 second to heat 4 degrees, i.e., dT/dt 4° C./second. At this rate, it would take 3.5 seconds or longer to heat from 162° C. to 176° C. Therefore, given the maximum period of 3.36 seconds between averaged readings on the same coil derived above, a cutoff or $T_S$ of 162° C. would ensure that the HC would be caught in time to prevent it from exceeding 176° C. Further, it should be noted that this lowered threshold temperature $T_S$ would only be necessary when printing at a resolution of 90 dpi. At other resolutions, viz., 72 dpi and less, the time between averaged coil temperature readings would be less than 2.71 seconds, so that a $T_S$ of 165° C. degrees would then be suitable for use.

Thus, to heat from a $T_S$ of 165° C. to 176° C. would take 2.75 seconds or longer, ensuring that, in a worst case, the HC would be caught before it exceeded 176° C.

As illustrated in FIG. 7B, the analysis for the example 1000 LPM, 60 hammer printer is similar. Thus, in a worst case analysis, with 99% of all dots on a given coil being printed, the coil takes about 1 second to heat 2 degrees, i.e., dT/dt=2° C./second. Accordingly, for a coil to heat from 168° C. to 176° C. would take 4 seconds or longer. Given the 3.6 second period between averaged readings on the coil for the example 1000 LPM printer discussed above, a $T_S$ of 168° C. would ensure that the HC was caught before it exceeded 176° C.

As summarized in Table 1 below, a $T_5$ of 162° C. would be a suitable choice for the example 500 LPM, 28 hammer line printer which is printing at a resolution of 73 dpi or greater, and a $T_S$ of 165° C. would be suitable for the same printer which is printing at a resolution of less than 73 dpi. For the example 1000 LPM, 60 hammer printer, the use of a $T_S$ of 168° C. would be suitable at resolutions less than or equal to 90 dpi.

| Printer | Resolution | $T_S$ |
|---|---|---|
| 500 LPM | ≥73 dpi | 162° C. |
| 500 LPM | <73 dpi | 165° C. |
| 1000 LPM | N/A | 168° C. |

Thus, at S65 of the method 300, in the case of the example 500 LPM printer, two values of $T_S$ are set, or stored in the printer that are dependent on the resolution being printed by the printer, and in the example 1000 LPM printer, a single value of $T_S$ that is independent of the print resolution is stored.

As those of some skill will understand, to prevent the printer from continually entering and exiting a HC condition, it is desirable to use some "hysteresis" value, i.e., some measure of the rate at which HC's cool down from an elevated temperature. Air-cooled coils cool relatively quickly when strokes are skipped; so it is not necessary to wait a very long interval for a coil to cool. Additionally, as discussed in more detail below, a hot coil dot per hammer ("HCDPHMax") printing density can selected that, even if printed continuously by the HC, will still enable the coil to cool down, albeit more slowly than if printing by the HC were stopped completely.

FIG. 5 is a graph, similar to those of FIGS. 7A and 7B above, of the temperature of a hammer coil in the example 1000 LPM, 60 hammer printer above, printing at a resolution of 72 dpi, as a function of time and the average dot density being printed by the coil, showing the cooling effect on the coil resulting from a two-second interruption in printing by the coil occasioned by a "weld skip" 302, i.e., the passage over the hammer bank of a non-printable "weld," or overlap, in a so-called "endless" or "Mobius" type ink ribbon. The printer is aware of the position of this weld in the ribbon and ceases printing while it is positioned in front of the hammer bank. As may be seen in FIG. 5, for the coils printing DPH densities of 50% and 65%, the temperature of each coil drops about 10° C. during the two-second interval, or at a rate dT/dt of about −5° C./second. Recalling that, as discussed above, the rate at which coils in the same printer heat up at a maximum rate of dT/dt=2° C./second, it can be seen that the coils cool down at a rate more than twice the rate at which they heat up.

This effect, referred to herein as "hysteresis" ("H"), provides a bound on the amount of time that a HC should be allowed to cool before resuming full performance printing on that coil so as to prevent inefficient "cycling" of the printer into and out of a HC condition. That is, when the printer enters a reduced print speed mode to prevent overheating of a coil, the printer will not be permitted to resume full performance printing until the temperature of the HC is less than or equal to $T_S$−H. Thus, in the example method 300 of FIG. 6, a value for H of about 10° C. can be selected at 6S7 and stored in the printer, then used as above to prevent cycling. For example, in the example 1000 LPM printer above, the printer will not be permitted to resume full performance until the temperature of a HC, $T_{HC}$, is ≤$T_S$−H, i.e., ≤168−10=158° C.

As discussed above, an important aspect of the method of the present invention involves reducing the performance of the printer when a HC reaches the set maximum allowable temperature $T_S$ so as to allow the HC to cool down, yet such that it does not skip any printing strokes unnecessarily. In one embodiment, this can be effected by first establishing a maximum dot-per-hammer density of a HC ("HCDPHMax"), as a percentage of the greatest possible density of dots that the HC hammer can print during a given stroke and at a given resolution, that will enable the HC to cool down from the maximum allowable temperature $T_S$ to an "acceptable" lower temperature, e.g., ≤$T_S$−H, then looking ahead in the print queue to the HC dot-per-hammer ("next HCDPH") density that is about to be printed by the HC during the next stroke of the hammer bank, and either a) printing the HCDPH of the next stroke if it is less than or equal to the HCDPHMax, or b) skipping the printing of the next HCDPH on that stroke and printing it in the next or a subsequent stroke of the hammer bank if it is greater than HDCPHMax.

The HCDPHMax coil parameter can be established empirically by looking at the temperature/time profile of a representative coil as a function of the percentage of the greatest possible density of dots that the HC hammer can print during a given stroke and at a given resolution, over a period of time that is long enough to allow the coil to stabilize in temperature.

Figure 8A:
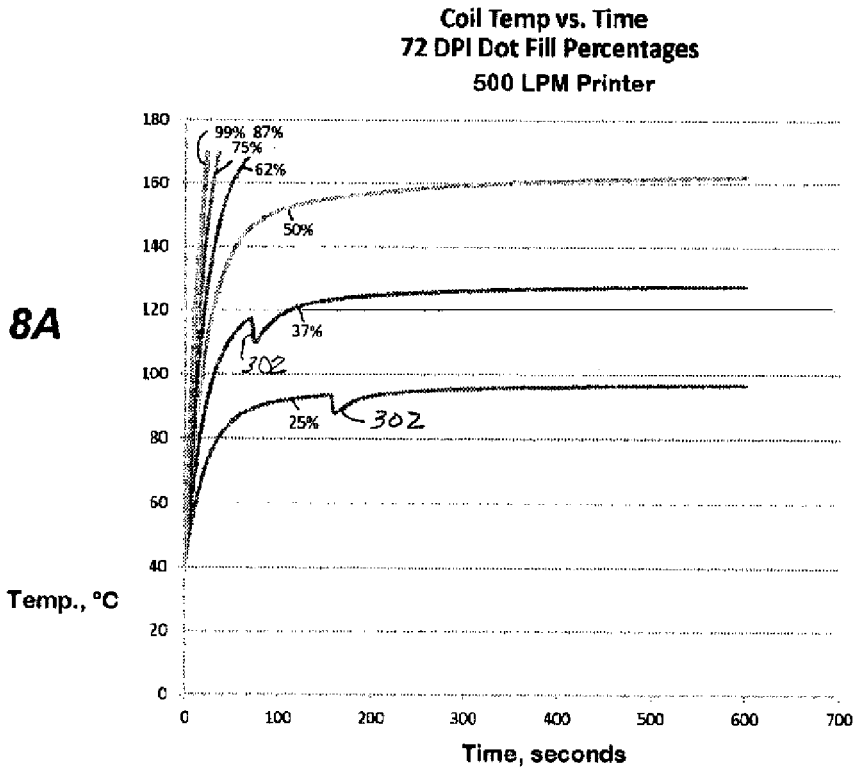
FIG. 8A is graph, similar to FIG. 7A, of the temperature of a hammer coil in the example 500 LPM printer, printing at a resolution of 72 dpi, as a function of time and the average dot density being printed by the coil, but showing a stabilization in the temperature of the coil over an extended period of time.
Figure 8B:
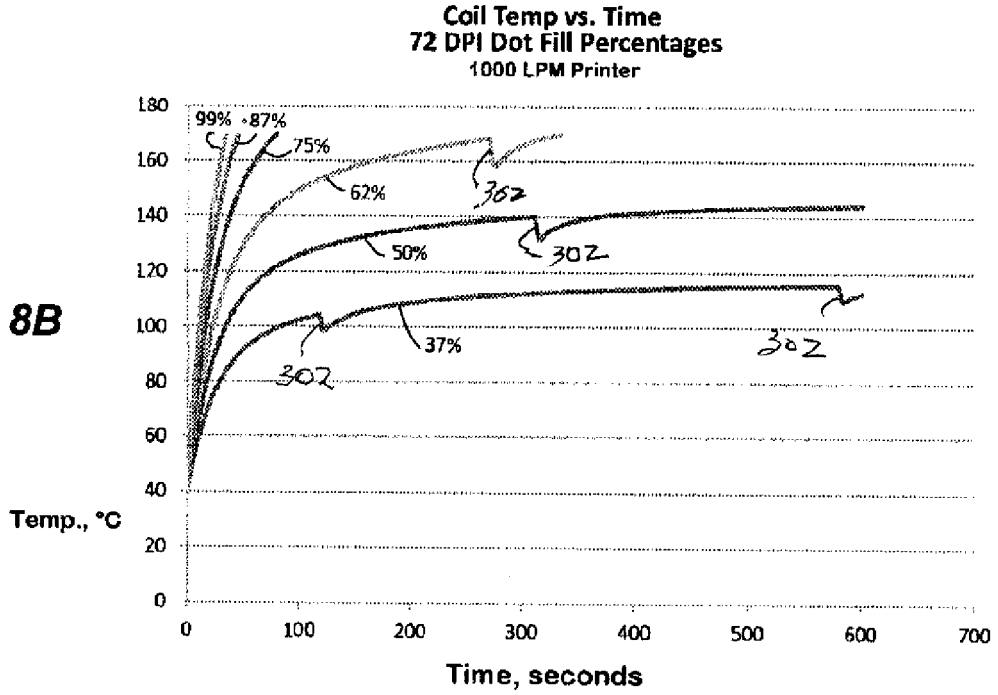
FIG. 8B is graph, similar to FIG. 7B, of the temperature of a hammer coil in the example 1000 LPM printer, printing at a resolution of 72 dpi, as a function of time and the average dot density being printed by the coil, but showing a stabilization in the temperature of the coil over an extended period of time.

FIG. 8A is graph, similar to FIG. 7A, of the temperature of a representative hammer coil in the example 500 LPM, 28 hammer line printer above, printing at a resolution of 72 dpi, as a function of time and the average dot density being printed by the coil, but over a period of time sufficiently long, viz., about 6 minutes, to enable the temperature of the coil to stabilize. FIG. 8B is a similar graph plotted for the example 1000 LPM, 60 hammer printer above. As in the above determinations, for both printers, a print resolution of 72 dpi was used as a "worst case" analysis, the densest pattern printed was 99% of all possible dots (72 dpi on the given hammer), the sparsest pattern printed was 25% of all possible dots (18 dpi on the given hammer), and all readings were taken at an ambient temperature of about 25° C.

As illustrated in FIG. 8, a given coil of the hammer bank stabilizes at a temperature $T_{STAB}$ of approximately 128° C. at this ambient temperature when printing a density of 37% of all possible dot positions on the given hammer. However, in a warmest allowable ambient temperature (such as in a very hot room), this temperature could be approximately 20° C. hotter; so the coil would have stabilized at temperature about 148° C. This temperature is far enough below the selected $T_{NTE}$ coil temperature (i.e., 185° C.) above to produce the desired hammer cooling. Thus, in order to cool HCs on the example 500 LPM shuttle, the HCDPHMax should be kept to an average of 37% or less.

It may be further noted from FIG. 8A that, printing at a DPH density of 50%, a coil will stabilize at a $T_{STAB}$ about 162° C. at an ambient temperature of 25° C., or at about 182°

C. in a hottest allowable ambient. Since the latter temperature exceeds the $T_S$ of the example 500 LPM printer for any resolution, the lower value of 37% could be chosen as the HCDPHMax because the HC will cool at this setting.

As illustrated in FIG. 8B, in the example 1000 LPM printer, a given coil stabilizes at a temperature $T_{STAB}$ of approximately 145° C. at an ambient temperature of 25° C. when printing at a density of 50% of all possible dot positions on the given hammer. In a warmest allowable ambient temperature (such as in a hot room), this temperature would be approximately 20° C. hotter; so the coil would have stabilized at a $T_{STAB}$ of about 165° C., which is too close to the $T_S$ of 168° C. of the example 1000 LPM printer discussed above (i.e., $>T_S-H=158°$ C.) to adopt as a HCDPHMax. On the other hand, the given coil stabilizes at a temperature of approximately 113° C. at a 25° C. ambient temperature when printing a density of 37% of all possible dot positions on the given hammer, and hence, at about 133° C. in a hot room.

Thus, to cool HCs in the example 1000 LPM printer both efficiently and effectively, the HCDPHMax should be kept to a level somewhere between these two levels. Therefore, a value of 43% could safely be chosen as the HCDPHMax for the example 1000 LPM printer because it is midway between the two dot densities. Thus, at 6S8 of the method 300, an initial value for HCDPHMax of about 43% or less could be selected for the example 1000 LPM printer as a value that will allow HCs to cool effectively.

Figure 9A:
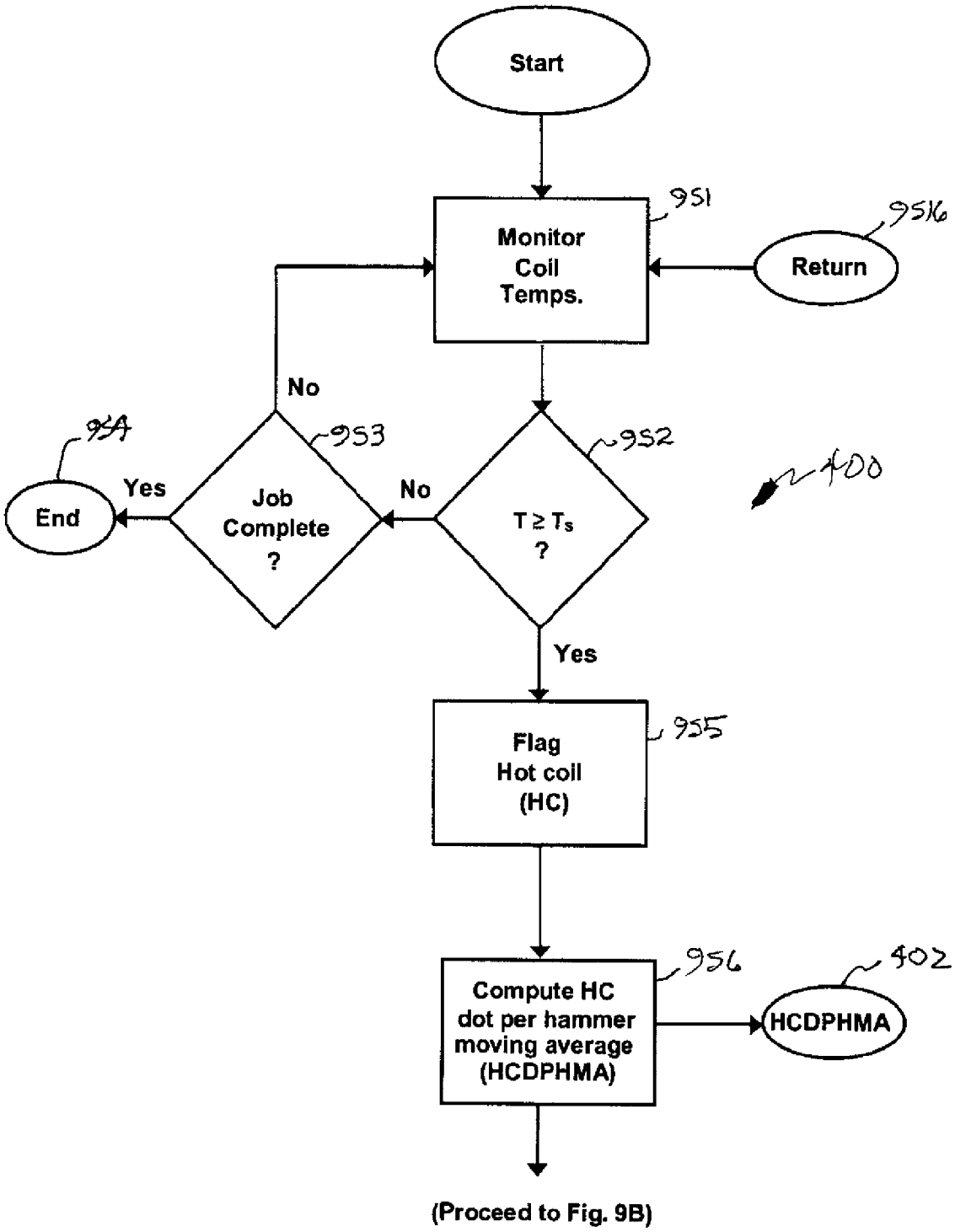
FIGS. 9A and 9B are flow diagrams illustrating an example embodiment of a method for preventing overheating of the coils in a line printer hammer in accordance with the present invention.
Figure 9B:
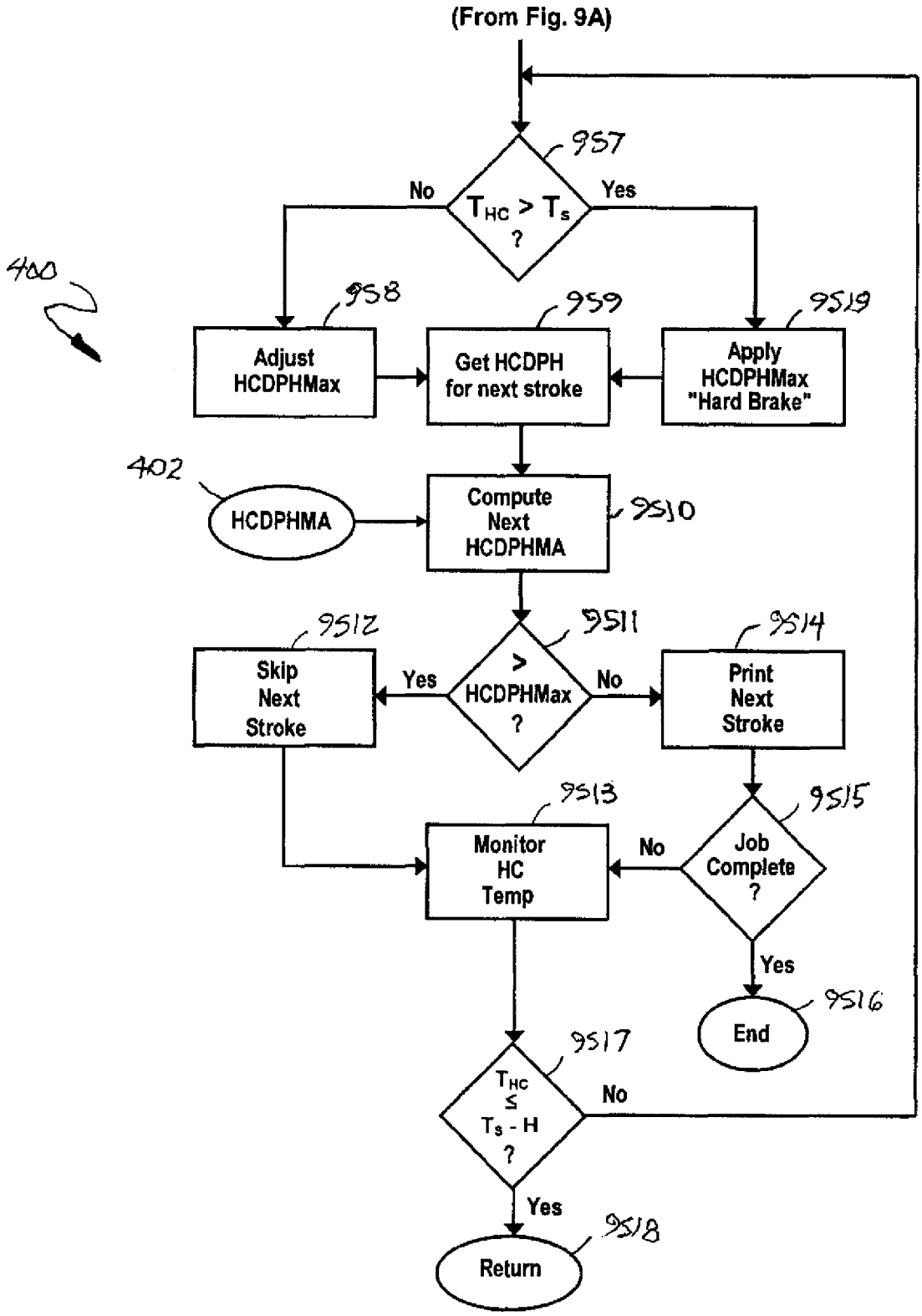

Having now fully provisioned the printer with the values of the coil parameters that are both appropriate to the particular printer and associated hammer bank at hand and necessary to effect the method for preventing hammer coil overheating of the present invention, reference is now made to FIGS. 9A and 9B, which are flow diagrams that together, illustrate an example embodiment of a method 400 for preventing line printer hammer coil overheating using the stored coil parameters discussed above.

In FIG. 9A, beginning at step 9S1, the temperature of each of the coils of the hammer bank is monitored continuously during printing in the manner described above, which, in the particular example 500 LPM printer described above, is effected every 3.36 seconds or less, and in the example 1000 LPM printer described above, every 3.6 seconds or less. At 9S2 of the method 400, a decision is made as to whether the temperature of any of the coils has reached or exceeded the particular temperature $T_S$ set in the printer for invoking coil overheating protection, i.e., whether $T \geq T_S$. If not, then the method 400 then proceeds to 9S3, where a determination is made as to whether the print job at hand is finished, i.e., has been completed, and if so, the printing and the method 400 both terminate a 9S4. If not, then printing continues and the method 400 proceeds back to 9S1, i.e., continuously monitoring the coil temperatures until a "hot coil" is identified or the print job is complete.

As discussed above, assuming that the thermal design of the hammer bank is adequate, then the temperature of each of the hammer bank coils will remain well below the critical point identified earlier, i.e., $T_{NTE}$. Thus, during the great majority of print jobs, the "loop" including the steps 9S1-9S3 of the method 400 would characterize the majority of jobs printed on the printer, i.e., the remaining steps of the method described below would not need to be invoked. However, as also discussed above, in a relatively small number of print job types, it is possible that the temperature of one or more of the hammer coils could rise to or beyond the level $T_S$ at which they are invoked in order to prevent overheating of the coils.

Thus, at 9S2, if a determination is made that the temperature of a coil is equal to or greater than $T_S$, then at 9S5, the method 400 "flags" that coil as a hot coil HC, and at 9S6, begins computing and recording a moving average HCDPHMA 402 of the number of dots printed on the associated hammer of that coil over prior strokes (with a ⅛ weight being placed on the most recent value).

The method 400 then proceeds to 9S7 (see FIG. 9B), where a determination is made as to whether $T_{HC}$ is greater than or equal to $T_S$. If $T_{HC}$ is equal to its set point $T_S$, then an initial "hard brake" value is set for HCDPHMax at 9S8. The method then proceeds to 9S9, at which the dots per hammer (HCDPH) that are scheduled to be printed by the HC on the next stroke of the hammer bank is retrieved from the print queue of the printer, and at 9S10, a "next" HCDPHMA is computed, using the HCDPH of the next stroke as the most recent value, i.e., assuming that the next HCDPH will be printed. At 9S11, a determination is then made whether the next HCDPH is greater than the maximum dot-per-hammer density of a HC (HCDPHMax) previously set at 9S8, as described above.

If at 9S11, it is determined that the next HCDPHMA is greater than HCDPHMax previously set, then at 9S12, 1) printing on the next stroke is omitted to allow the HC to cool more rapidly, 2) the print medium is not advanced to the next row for printing, but rather, remains at the same row, 3) the scheduled HCDPH that was omitted becomes the HCDPH for the next (or a subsequent) stroke of the hammer bank at that same row, 4) the next HCDPHMA is computed at 9S10 based on the last row of dots having been skipped, i.e., as if the HCDPH for the previous stroke were zero, and 5) the method 400 then proceeds to 9S13, at which the temperature of the HC is monitored.

On the other hand, if at 9S11, it is determined that the next HCDPHMA is less than or equal to HCDPHMax, i.e., can be printed and still allow the HC to cool (albeit more slowly than if printing had been completely skipped during that stroke), then at 9S14, the next HCDPH is printed during the next stroke of the hammer bank, and the method 400 proceeds to 9S15, where a determination is made as to whether the print job is complete. If so, printing and the method 400 both terminate at 9S16. If not, then the method 400 again proceeds to 9S13, as above.

At 9S13, the method 400 monitors the temperature of the HC, which as discussed above, occurs every 0.5 seconds, and proceeds to 9S17, where a determination is made as to whether the temperature of the HC, $T_{HC}$, has fallen to an acceptable level, viz, $T_{HC} \leq T_S-H$. If not, then the method 400 returns to 9S7, where the foregoing steps of the process are repeated, but with the values of the next stroke HCDPH and HCDPHMA being appropriately modified as described above, depending on whether printing occurred or was skipped during the previous stroke. If, on the other hand, it is determined at 9S17 that $T_{HC}$ has fallen to an acceptable level, i.e., to $\leq T_S-H$, then the method proceeds to 9S18, i.e., it returns to the first step 9S1 of the method in FIG. 9A, i.e., the monitoring of the temperature of the coils for any HCs is resumed, as described above.

Using the example method 400 described thus far, the initial or default value of HCDPHMax as selected above should be adequate to ensure that no coil ever exceeds its temperature set point, $T_S$. However, due primarily to the possibility of poor accuracy in the coil temperature readings, a fixed value of HCDPHMax is not always adequate, and it may become necessary to manipulate this parameter as follows.

Referring to FIGS. 9A and 9B, if at 9S7, it is determined that the temperature of the HC $T_{Hc}$ is actually greater than the allowable set temperature $T_S$, then in some embodiments, the method 400 can be programmed to apply a "hard brake" on the printing to begin cooling the HC at a greater rate than as provided for above. Thus, at 9S19, the method 400 can adjust the HCDPHMax to a value lower than the default value, and then proceed at 9S9 as described above. It should be noted that this adjustment will only affect printer performance so long as the HC continues to print pattern densities that are dense enough to reach the adjusted HCDPHMax. After the temperature $T_{HC}$ of the HC falls below the threshold plus hysteresis, i.e., is $\leq T_S-H$, as determined at 9S17, the printing is no longer held back by HCDPHMax. Thus, in some embodiments, the value of HCDPHMax can be adjusted either up or down during each stroke of the shuttle so as to prevent the temperature of the HC from rising too far above the threshold $T_S-H$, and thereby eliminate the need to reapply the hard brake.

In some embodiments, the method 400 can be configured such that, any time that a HC condition in the printer causes enough skipped strokes to reduce the overall printer performance over a given interval, e.g., 5 seconds, by a given percentage, e.g., 33% or more, the software of the method 400 can cause a "Half Speed Mode" message to be displayed on a front panel indicator or display of the printer to alert a user that the printer's speed has been reduced to cool the hammer bank. This message can be removed automatically when the printer passes through, e.g., a 5 second interval with less than, e.g., 5% of an overall reduction in speed due to a HC. This arrangement can prevent transient skipped strokes that do not appreciably affect performance from flashing spurious messages on the printer.

As those of some skill will appreciate, the foregoing methods contemplate that production hammer banks will function approximately the same as the representative hammer banks used to produce the empirically obtained coil parameters. However, different hardware, faulty hardware, or erroneous coil temperature readings, could prevent the methods from achieving their desired objects. To protect against such an eventuality, the example method 400 can be augmented to provide, for example that, if the software of the method ever sees the temperature in a coil rise higher than, for example, an average of, e.g., 8° C. per second, it will flag a fatal error, e.g., "CTEMP HW ERR/Call Service". Such a message would indicate to users that something in the hardware or software was not behaving in the expected manner, and that it was not safe to continue printing with the printer because the hammer coils could be damaged.

Likewise, if coils do not cool properly when the correct number of strokes is skipped, the method 400 can be modified to conclude that a hardware error exists. Coils that do not cool properly will continue to rise in temperature, even when the number of dots per hammer per unit time is restricted. For example, if the software of the method ever reads a value higher than 185° C. on a coil, the method can be modified to cease all further printing and to display a fatal fault "COIL HOT ERR 1/Call Service" message to the user.

Indeed, in light of the foregoing description, it will be clear to those of skill in the art that many modifications, substitutions and variations can be made in the methods and apparatus of the present invention for preventing line printer hammer coil overheating, and in light thereof, the scope of the present disclosure should not be limited to that of the particular embodiments illustrated and described herein, which are presented merely by way of some examples thereof, but rather, should be fully commensurate with that of the claims appended hereafter and their functional equivalents.

What is claimed is:

1. A method for preventing a hammer coil of a line printer hammer bank from overheating during printing, the method comprising:

establishing a maximum allowable temperature of the coil, $T_S$;

deriving a temperature hysteresis H value for the coil;

determining an initial value of a hard brake maximum dot-per-hammer density, HCDPHMax, that the coil can print per stroke of the hammer bank that will enable the coil to cool down from the maximum allowable temperature $T_S$;

monitoring the temperature of the coil during printing;

flagging the coil as a hot coil, HC, if the temperature of the coil rises to or exceeds $T_S$;

adjusting HCDPHMax based on the rate of cooling of the coil; and adjusting the rate of printing by the coil to HCDPHMax when and for as long as the temperature of the coil remains at or above $T_S-H$.

2. The method of claim 1, wherein the establishing comprises:

selecting a not-to-exceed coil temperature $T_{NTE}$ that is based on a physical characteristic of the coil;

selecting a greatest likely error $T_{ER}$ in the measurement of the coil temperature;

computing the longest possible interval of time $t_{meas}$ between successive temperature measurements of the coil when printing;

computing the greatest possible rate of heating dT/dt of the coil when printing; and setting $T_S=T_{NTE}-T_{ER}-(t_{meas}\times dT/dt)$.

3. The method of claim 1, wherein the determining comprises:

measuring the temperature $T_{STAB}$ at which the coil stabilizes for various percentages of the greatest possible density of dots that the coil can print per stroke of the hammer bank when printing at a given print resolution and a highest allowable ambient temperature; and adjusting HCDPHMax the largest percentage of dots that results in a $T_{STAB}$ of the coil that is less than $T_S$.

4. The method of claim 1, wherein the monitoring comprises:

measuring the temperature of the coil during every stroke of the hammer bank for four consecutive strokes; and averaging the four measurements to provide a measurement of the current temperature of the coil.

5. The method of claim 1, wherein the slowing comprises:

computing a moving average of the number of dots printed by the coil over prior strokes of the hammer bank, HCDPHMA;

retrieving from a print queue of the printer the dots per hammer HCDPH that are scheduled to be printed by the coil on the next stroke of the hammer bank;

computing a next HCDPHMA using the HCDPH of the next stroke as the most recent value;

printing the HCDPH of the next stroke on the next stroke of the hammer bank if the next HCDPHMA is less than or equal to HCDPHMax; and skipping the printing of the HCDPH of the next stroke on the next stroke of the hammer bank if the next HCDPHMA is greater than HCDPHMax.

6. The method of claim 1, further comprising:

selecting a value of hysteresis H for the coil that is a function of a rate at which the coil cools down from $T_S$ when not printing; and increasing the rate of printing by the coil to a default rate that is greater than the HCDPHMax when the temperature of the coil falls to a value less than or equal to $T_S$–H.

7. The method of claim 1, further comprising adjusting the HCDPHMax to a lower value it when and for so long as the temperature of the coil is greater than $T_S$.

8. A non-transitory machine-readable medium comprising a plurality of machine-readable instructions which, when executed by one or more processors in a line printer, cause the line printer to perform a method comprising steps of:

monitoring the temperature of a hammer coil in a hammer bank of the line printer during printing;

retrieving a stored value of a maximum allowable temperature previously established for the coil, $T_S$;

flagging the coil as a hot coil, HC, if the temperature of the coil rises to or exceeds $T_S$;

computing a moving average of the number of dots printed by the coil over prior strokes of the hammer bank, HCDPHMA;

scanning a print queue of the printer for and retrieving from the print queue of the printer the dots per hammer HCDPH that are scheduled to be printed by the coil on the next stroke of the hammer bank;

computing a next HCDPHMA using the HCDPH of the next stroke as the most recent value;

retrieving and dynamically adjusting a stored value of a maximum dot-per-hammer density, HCDPHMax, that the coil can print per stroke of the hammer bank that will enable the coil to cool down from the maximum allowable temperature $T_S$;

printing the HCDPH of the next stroke on the next stroke of the hammer bank if the next HCDPHMA is less than or equal to HCDPHMax; and skipping the printing of the HCDPH of the next stroke on the next stroke of the hammer bank if the next HCDPHMA is greater than HCDPHMax.

9. The medium of claim 8, wherein the method further comprises:

retrieving a stored value of a hysteresis previously selected for the coil, H; and increasing the rate of printing by the coil to a default rate that is greater than the HCDPHMax if and when the temperature of the coil falls to a value less than or equal to $T_S$–H.

10. The medium of claim 8, wherein the method further comprises adjusting the HCDPHMax to a lower value if the temperature of the coil reaches a value greater than $T_S$.

11. The medium of claim 8, wherein the stored value of $T_S$ is established by:

selecting a not-to-exceed coil temperature $T_{NTE}$ that is based on a physical characteristic of the coil;

selecting a greatest likely error $T_{ER}$ in the measurement of the coil temperature;

computing the longest possible interval of time tmeas between successive temperature measurements of the coil when printing;

computing the greatest possible rate of heating dT/dt of the coil when printing; and setting $T_S = T_{NTE} - T_{ER} - (t_{meas} \times dT/dt)$.

12. The medium of claim 8, wherein the stored value of HCDPHMax is determined by:

measuring the temperature $T_{STAB}$ at which the coil stabilizes for various percentages of the greatest possible density of dots that the coil can print per stroke of the hammer bank when printing at a given print resolution and a highest allowable ambient temperature; and selecting as HCDPHMax the largest percentage of dots that results in a $T_{STAB}$ of the coil that is less than $T_S$.

13. The medium of claim 8, wherein the monitoring comprises:

measuring the temperature of the coil during every stroke of the hammer bank for four consecutive strokes; and averaging the four measurements to provide a measurement of the current temperature of the coil.

14. The medium of claim 9, wherein the hysteresis of the coil, H, is selected as a function of a rate at which the coil cools down from $T_S$ when not printing.

15. A line printer, comprising:

a hammer bank having at least one hammer bank coil;

a memory storing a value of a maximum allowable temperature of the at least one hammer bank coil, $T_S$;

a memory storing a value of a maximum dot-per-hammer density, HCDPHMax, that the at least one hammer bank coil can print per stroke of the hammer bank that will enable the at least one hammer bank coil to cool down from the maximum allowable temperature $T_S$; and at least one processor programmed to perform a method preventing overheating of the coils of the hammer bank comprising steps of:

monitoring the temperature of the at least one hammer bank coil during printing;

retrieving the stored value of $T_S$;

flagging the at least one coil as a hot hammer bank coil, HC, if the temperature of the at least one rises to or exceeds $T_S$;

computing a moving average of the number of dots printed by the at least one hammer bank coil over prior strokes of the hammer bank, HCDPHMA;

scanning a print queue of the printer for and retrieving from the print queue of the printer the dots per hammer HCDPH that are scheduled to be printed by the at least one hammer bank coil on the next stroke of the hammer bank;

computing a next HCDPHMA using the HCDPH of the next stroke as the most recent value;

retrieving the stored value of HCDPHMax;

printing the HCDPH of the next stroke on the next stroke of the hammer bank if the next HCDPHMA is less than or equal to HCDPHMax; and skipping the printing of the HCDPH of the next stroke on the next stroke of the hammer bank if the next HCDPHMA is greater than HCDPHMax.

16. The line printer of claim 15, wherein:

the printer further comprise a memory storing a value of hysteresis H for the at least one hammer bank coil that is a function of the rate at which the at least one hammer bank coil cools down from $T_S$ when not printing; and the method further comprises increasing the rate of printing by the at least one hammer bank coil to a default rate that is greater than the HCDPHMax when the temperature of the at least one hammer bank coil falls to a value less than or equal to $T_S$–H.

17. The line printer of claim 15, wherein the method further comprises adjusting the HCDPHMax to a lower value if when and for so long as the temperature of the at least one hammer bank coil is greater than $T_S$.

18. The line printer of claim 15, wherein:

the display further comprises a display on a front panel of the printer; and if a value for $T_S$ has not been previously stored in the memory, the method further comprises displaying a message on the display to a user of the printer indicating that the value is missing and should be supplied.

19. The line printer of claim 18, wherein the method further comprises displaying a message on the display indicating that the printer is printing at a reduced rate of speed when the performance of the printer has been reduced by a given percentage for a predetermined period of time.

20. The line printer of claim 18, wherein the method further comprises stopping all printing by the printer and displaying a printer fault message on the display if the temperature of the at least one hammer bank coil reaches a predetermined not-to-exceed temperature, $T_{NTE}$.

* * * * *